US005493180A

United States Patent [19]

Bezdon et al.

[11] Patent Number: 5,493,180

[45] Date of Patent: Feb. 20, 1996

[54] LAMP PROTECTIVE, ELECTRONIC BALLAST

[75] Inventors: Ronald J. Bezdon, Antioch; Randy G. Russell, Glen Ellyn; Peter W. Shackle, Arlington Heights, all of Ill.

[73] Assignee: Energy Savings, Inc., a Delaware Corporation, Schaumburg, Ill.

[21] Appl. No.: 416,022

[22] Filed: Mar. 31, 1995

[51] Int. Cl.[6] ..... H05B 39/10

[52] U.S. Cl. ..... 315/91; 315/106; 315/107; 315/307

[58] Field of Search ..... 315/91, 107, 106, 315/86, 88, 117, 307

[56] References Cited

U.S. PATENT DOCUMENTS

| | | | |
|---|---|---|---|
| 4,513,226 | 4/1985 | Josephson | 315/219 |
| 4,562,383 | 12/1985 | Kerscher et al. | 315/225 |
| 4,893,059 | 1/1990 | Nilssen | 315/127 |
| 5,099,407 | 3/1992 | Thorne | 363/37 |
| 5,101,140 | 3/1992 | Lesea et al. | 315/244 |
| 5,214,355 | 5/1993 | Nilssen | 315/219 |
| 5,394,062 | 2/1995 | Minarczyk et al. | 315/129 |

*Primary Examiner*—Frank Gonzalez
*Assistant Examiner*—Reginald A. Ratliff
*Attorney, Agent, or Firm*—Cahill, Sutton & Thomas

[57] ABSTRACT

A lamp protective, electronic ballast includes a lamp voltage detector having a capacitor and resistor series connected across a discharge lamp. The junction of the resistor and capacitor is coupled to a voltage sensitive switch for detecting DC offset on the lamp and excessive AC voltage on the lamp. The switch is more sensitive to DC offset than to excessive AC voltage and is disabled while the lamp is started.

9 Claims, 5 Drawing Sheets

LAMP PROTECTIVE, ELECTRONIC BALLAST

BACKGROUND OF THE INVENTION

This invention relates to electronic ballasts for gas discharge lamps and, in particular, to an electronic ballast which protects a fluorescent lamp from dissipating excessive power at or near the end of the life of the lamp.

A fluorescent lamp is an evacuated glass tube with a small amount of mercury in the tube. The tube is lined with an adherent layer of a mixture of phosphors. Some of the mercury vaporizes at the low pressure within the tube and a filament or cathode in each end of the tube is heated to emit electrons into the tube, ionizing the gas. A high voltage between the filaments causes the mercury ions to conduct current, producing a glow discharge which emits ultraviolet light. The ultraviolet light is absorbed by the phosphors and re-emitted as visible light.

A gas discharge lamp is a non-linear load, i.e. the current through the lamp is not directly proportional to the voltage across the lamp. Current through the lamp is zero until a minimum voltage is reached, then the lamp conducts. Once the lamp conducts, current through the lamp will increase rapidly unless there is a ballast in series with the lamp to limit current.

A magnetic ballast is an inductor in series with a lamp for limiting current. An electronic ballast is a power supply especially designed for gas discharge lamps and typically includes a rectifier for changing alternating current (AC) into direct current (DC) and an inverter for changing the direct current to alternating current at high frequency, typically 25–60 khz. Some electronic ballasts include a boost circuit between the rectifier and the inverter for increasing the voltage supplied to the inverter.

It is conventional in electronic ballasts for gas discharge lamps to provide protection for the ballast or for a person in the event of one or another fault condition. For example, U.S. Pat. No. 5,099,407 (Thorne) describes a ballast including a "runaway protection circuit" to prevent the ballast from destroying itself when the lamp is removed while power is applied. U.S. Pat. No. 5,101,140 (Lesea) describes an electronic ballast including a series capacitor for limiting output current in the event of a short circuit. U.S. Pat. No. 4,893,059 (Nilssen) describes a ballast that protects a person from "through lamp leakage" when the person removes only one end of a tubular lamp from its socket and touches the exposed pins. The leakage is detected and the ballast shuts off before the person is electrocuted.

The fluorescent lamp has been made very much more efficient in recent years by reducing the diameter of the tube and by operating the lamp at higher temperatures. Fluorescent lamps are designated by a code in which the diameter of the tube is expressed in eighths of an inch. Thus, "T12" refers to an older, tubular lamp having a diameter of one and one-half inches. The newer, more efficient T8 lamps are tubular and one inch in diameter. T5 fluorescent lamps are now being introduced and there are laboratory prototypes of T2 lamps. Some smaller diameter lamps are folded to make a less elongated light source. A folded lamp is known as a compact and is typically a T4 lamp.

A smaller diameter fluorescent lamp typically runs at high bulb temperature, e.g. 200° F. near the filaments. At the end of the life of such a lamp, one filament usually stops emitting electrons before the other filament and the lamp begins to rectify the current through it. This is called diode mode operation. If a ballast having a capacitive current limiter powers the lamp, the current through the lamp is forced to remain balanced in each direction but the voltage across the lamp becomes asymmetrical, i.e. there is a net DC potential across the lamp. When a lamp operates in diode mode, there is a large voltage drop inside the glow discharge adjacent the failed filament. Ions in the discharge are accelerated to high energies and bombard the filament, dissipating large amounts of energy and raising the already high temperature of the filament even further.

Occasionally, a filament will become so hot that the glass tube melts and the lamp implodes, producing anything from cracked glass and melted plastic to a shower of droplets of molten glass and hot glass splinters. A fire may be ignited. Such failures were almost unknown with T12 or T8 lamps because the large diameter of the tube provided clearance between the filament and the tube wall. T2, T4, and T5 lamps have such little clearance that additional heating of the filaments from operating in diode mode can readily cause an implosion.

Diode mode of operation can often damage a ballast because of the asymmetrical current drawn from the ballast and because of the high voltages the ballast is called upon to produce. It is known in the art to detect diode mode for the purpose of protecting the ballast, e.g. U.S. Pat. No. 5,394,062 (Minarczyk). The ballast described in the Minarczyk patent only detects excess voltage across the lamp, i.e. the ballast detects voltage magnitude and not direction, while it is necessary to detect and react to excessive AC voltage across a lamp, the sensitivity of the small diameter lamps is so great that it is also desired to detect voltage asymmetry of no more than 20 volts DC in a lamp that is operating at 120 volts AC. By detecting diode mode, a ballast can be shut down well before overheating of the filaments can occur.

There are several technical problems with incorporating lamp protection circuitry into an electronic ballast. One problem is that large voltages, often with momentary asymmetry, are applied to a lamp in order to initiate conduction through the lamp. For example, it may be necessary to apply 300 volts rms to ignite a 120 volt fluorescent lamp and yet it is desired to detect that the same lamp is operating at 220 volts rms. It is desirable that a ballast react to an excessive, steady state, AC voltage by shutting off and not react to an even larger, asymmetrical, transient voltage for starting the lamp.

A second problem is that the operating voltage of fluorescent lamps increases with age and that operation in diode mode is far more destructive than operating at slightly higher but symmetrical AC voltage. As used herein, "DC sensitivity" refers to operation in diode mode and "AC sensitivity" refers to operation with a symmetrical AC voltage across the lamp. Thus, the need is for a lamp protection circuit that does not shut off the lamp during starting and which has much higher DC sensitivity than AC sensitivity. It is desired for the protection circuitry to trigger at a DC offset of no more than 10 volts and at an AC voltage exceeding normal operating voltage by 100 volts.

In order to protect a lamp, or a ballast, or a person touching the lamp or the ballast, it is not necessary that the ballast be completely turned off. Some ballasts react to faults by literally shutting off some or most of the circuitry in the ballast. Other ballasts, e.g. ballasts having series resonant, parallel loaded outputs, increase the operating frequency of the ballast, thereby reducing the voltage applied to the lamp. The voltage is reduced to the point that the lamp stops conducting. As used herein, "shutting off" an inverter means, at a minimum, reducing the power supplied to a lamp in order to prevent harm to the ballast, the lamp, or a person coming into contact with the ballast or the lamp.

In view of the foregoing, it is therefore an object of the invention to provide an electronic ballast including circuitry for protecting gas discharge lamps.

Another object of the invention is to provide an electronic ballast that can detect an asymmetry in the voltage across the lamp of as little as twenty volts and shut off the ballast.

A further object of the invention is to provide an electronic ballast that does not detect starting voltages as a fault condition.

Another object of the invention is to provide an electronic ballast that detects diode mode of operation and overvoltage.

A further object of the invention is to provide an electronic ballast that responds quickly to a fault condition to prevent destruction of a lamp powered by the ballast.

Another object of the invention is to provide an electronic ballast that includes relatively few additional components to provide protection for a lamp powered by the ballast.

A further object of the invention is to provide lamp protection circuitry with high DC sensitivity and low AC sensitivity.

SUMMARY OF THE INVENTION

The foregoing objects are achieved in the invention in which an electronic ballast includes a lamp voltage detector having a capacitor and resistor series connected across a discharge lamp. The junction of the resistor and capacitor is coupled to a control input of a switch circuit for disabling the ballast. In one embodiment of the invention, the ballast includes a half-bridge inverter driven by a control circuit coupled to the switch circuit. The junction of the resistor and capacitor is coupled by a DIAC to the switch circuit for detecting diode mode operation. The switch circuit is powered by a storage capacitor coupled to a charge pump circuit coupled to the lamp. Sustained, excess voltage on the lamp is detected by a zener diode coupled between the storage capacitor and the control input of the switch circuit.

In a second embodiment of the invention, the lamp voltage detector includes a capacitor and resistor series connected across a discharge lamp and the junction thereof is coupled to a switch circuit. The switch circuit is powered by the capacitor and excess voltage is detected by a zener diode coupled between the capacitor and a control input of the switch circuit.

In a third embodiment of the invention, the lamp voltage detector includes a comparator having a first input coupled to the center point of a half-bridge inverter and a second input coupled to the half-bridge capacitor. The comparator detects diode mode. Sustained, excess voltage on the lamp is detected by a voltage sensitive switch coupled to either input of the comparator.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
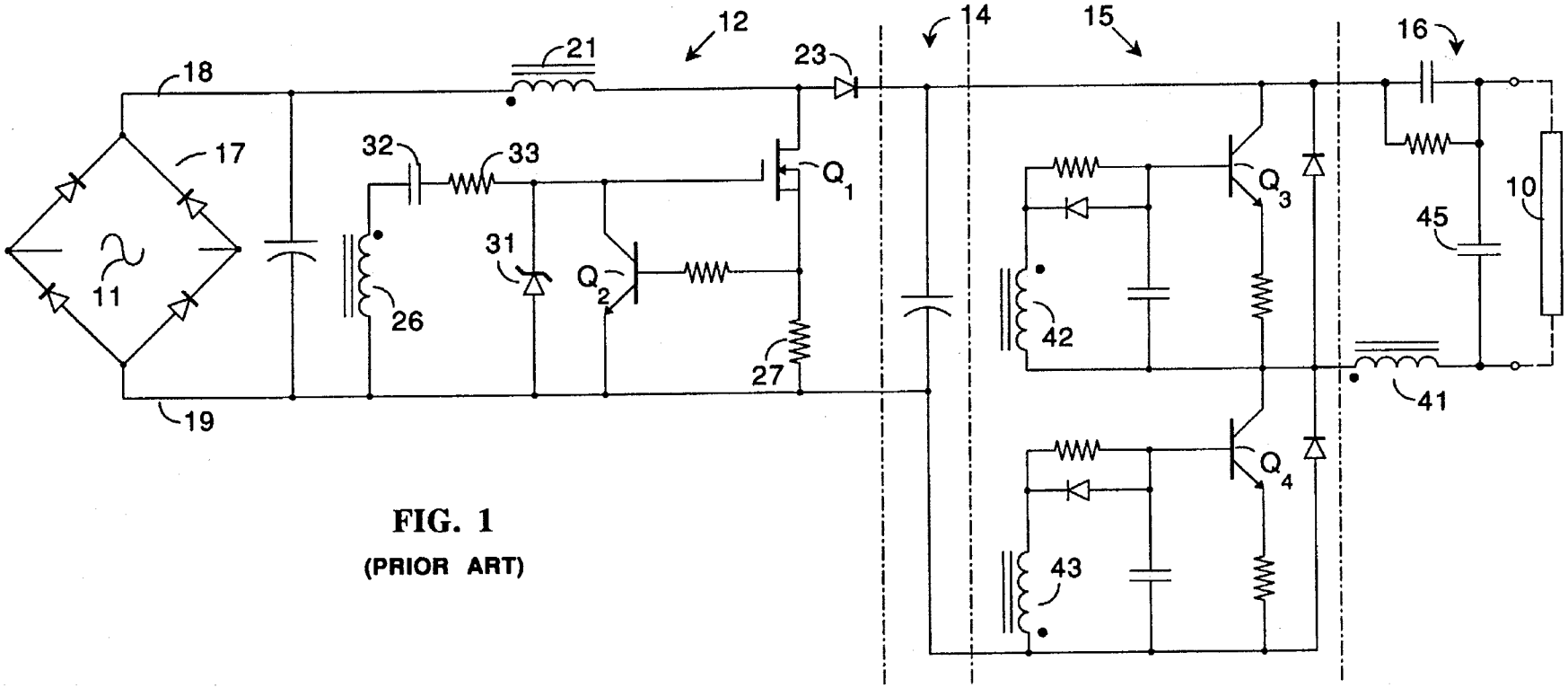
FIG. 1 (PRIOR ART)
FIG. 1 is a schematic illustration of the principal components of an electronic ballast.

FIG. 1 illustrates the major components of an electronic ballast for connecting fluorescent lamp 10 to an AC power line, represented by waveform 11. FIG. 1 is an inoperative simplification that is representative of, but not the same as, such prior art as U.S. Pat. No. 4,562,383 (Kirscher et al.) and U.S. Pat. No. 5,214,355 (Nilssen). The prior art and the invention are illustrated with a single lamp for the sake of simplicity. The invention can be used with ballasts powering more than one lamp.

The electronic ballast in FIG. 1 includes converter 12, energy storage capacitor 14, inverter 15, and output 16. Converter 12 rectifies the alternating current from the AC power line and stores it on capacitor 14. Inverter 15 is powered by the energy stored in capacitor 14 and provides a high frequency, e.g. 30 khz, alternating current through output 16 to lamp 10.

Converter 12 includes bridge rectifier 17 having DC output terminals connected to rails 18 and 19. If rectifier 17 were connected directly to capacitor 14, then the maximum voltage on capacitor 14 would be approximately equal to the peak of the applied voltage. The voltage on capacitor 14 is increased to a higher voltage by a boost circuit including inductor 21, transistor $Q_1$, and diode 23. When transistor $Q_1$ is conducting, current flows from rail 18 through inductor 21 and transistor $Q_1$ to rail 19. When transistor $Q_1$ stops conducting, the field in inductor 21 collapses and the inductor produces a high voltage pulse, which adds to the voltage from bridge rectifier 17 and is coupled through diode 23 to capacitor 14. Diode 23 prevents current from flowing back to transistor $Q_1$ from capacitor 14.

A pulse signal must be provided to the gate of transistor $Q_1$ in order to turn $Q_1$ on and off periodically to charge capacitor 14. Inductor 26 is magnetically coupled to inductor 21 and provides feedback to the gate of transistor $Q_1$, causing transistor $Q_1$ to oscillate at high frequency, i.e. a frequency at least ten times the frequency of the AC power line, e.g. 30 khz. The source of an initial pulse signal is not shown in FIG. 1.

A boost circuit and an inverter can each be self-oscillating, triggered, or driven. In addition, each can have a variable frequency or a fixed frequency. The circuit in FIG. 1 is simplified to illustrate the basic combination of converter and inverter. As illustrated in FIG. 1, the boost circuit is a variable frequency boost, unlike the boost circuits shown in the Kirscher et al. and Nilssen patents. Switch-mode power supplies use variable frequency boost circuits and typically exhibit high harmonic distortion. Resistor 27 causes the boost circuit of FIG. 1 have a variable frequency.

Resistor 27, in series with the source-drain path of transistor $Q_1$, provides a feedback voltage that is coupled to the base of transistor $Q_2$. When the voltage on resistor 27 reaches a predetermined magnitude, transistor $Q_2$ turns on, turning off transistor $Q_1$, zener diode 31 limits the voltage on the gate of transistor $Q_1$ from inductor 26 and capacitor 32 and resistor 33 provide pulse shaping for the signal to the gate of transistor $Q_1$ from inductor 26. Since the voltage drop across resistor 27 will reach the predetermined magnitude more quickly as the AC line voltage increases, more pulses per unit time will be produced by the boost, i.e. the frequency will increase. When the AC line voltage decreases, the frequency will decrease.

In inverter 15, transistors $Q_3$ and $Q_4$ are series connected between rails 18 and 19 and conduct alternately to provide high frequency pulses to lamp 10. Inductor 41 is series connected with lamp 10 and is magnetically coupled to inductors 42 and 43 for providing feedback to transistors $Q_3$ and $Q_4$ to switch the transistors alternately. The oscillating frequency of inverter 15 is independent of the frequency of converter 12 and is on the order of 25–50 khz. Output 16 is a series resonant LC circuit including inductor 41 and capacitor 45. Lamp 10 is coupled in parallel with resonant capacitor 45 in what is known as a series resonant, parallel coupled or direct coupled output.

If the line voltage increases, then resistor 27 turns transistor $Q_1$ off slightly sooner during each cycle of the boost circuit, thereby increasing the frequency of converter 12. As the frequency of converter 12 increases, the voltage on capacitor 14 increases. If inductors 41, 42, and 43 were saturating inductors, the increased voltage across capacitor 14 would cause the inductors to saturate slightly sooner each cycle because of the increased current. Thus, the frequency of inverter 15 would also increase with increasing line voltage.

Figure 2:
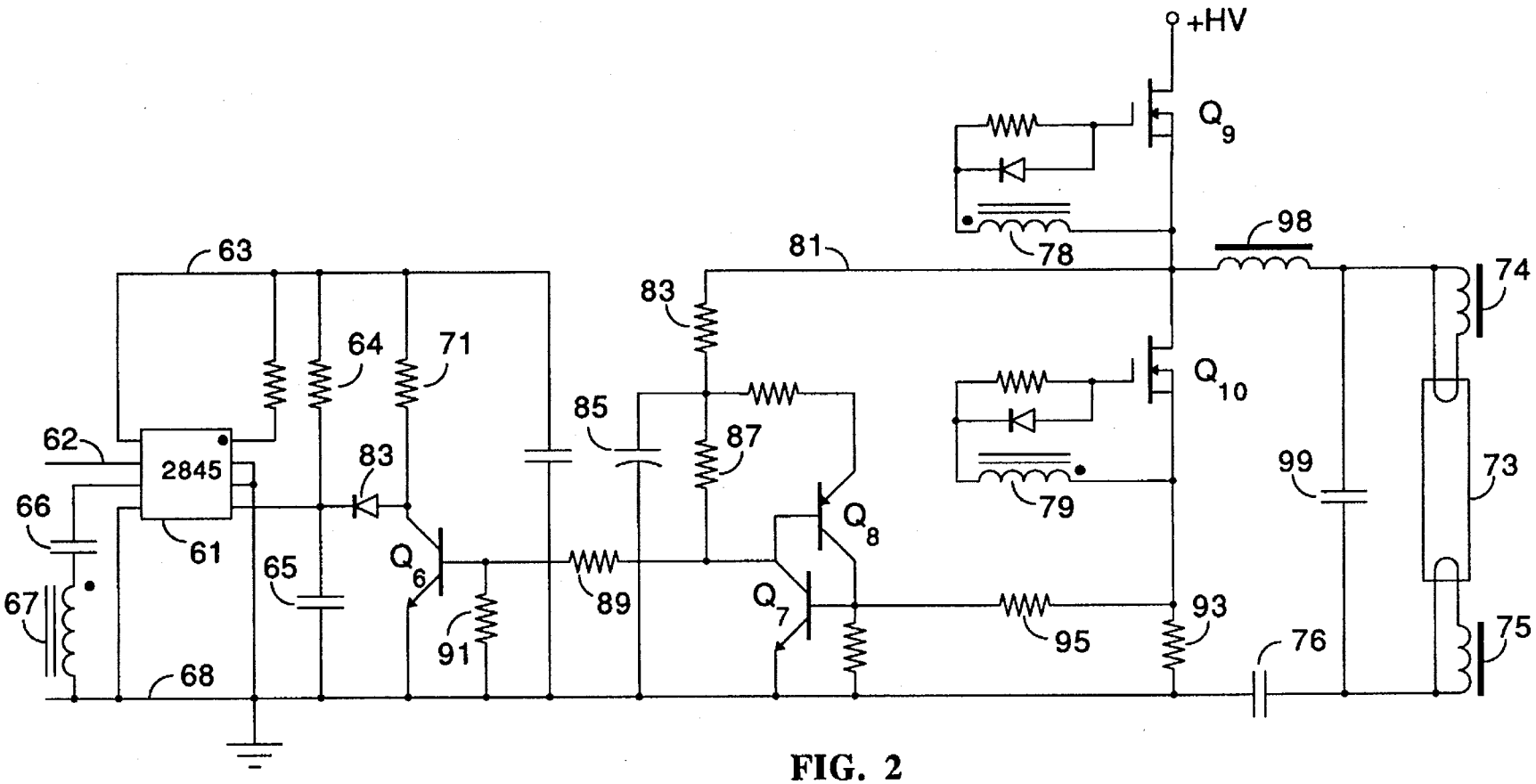
FIG. 2 (PRIOR ART)
FIG. 2 is a schematic diagram of a portion of an electronic ballast of the prior art.

In FIG. 2, the inverter includes a variable frequency driver circuit having frequency determining elements including a transistor acting as a variable resistor. Driver circuit 61 is powered from low voltage line 62 connected to pin 7 and produces a local, regulated output of approximately five volts on pin 8, which is connected to rail 63. Driver circuit 61 is a 2845 pulse width modulator. In FIG. 2, pin 1 of driver circuit 61 is indicated by a dot and the pins are numbered consecutively clockwise.

Pin 1 of driver circuit 61 relates to an unneeded function and is tied high. Pins 2 and 3 relate to unneeded functions and are grounded. Pin 4 is the frequency setting input and is connected to an RC timing circuit including resistor 64 and capacitor 65. Pin 5 is electrical ground for driver circuit 61 and is connected to rail 68. Pin 6 of driver circuit 61 is the high frequency output and is coupled through capacitor 66 to inductor 67. Inductor 67 is magnetically coupled to inductor 78 and to inductor 79. As indicated by the small dots adjacent each inductor, inductors 78 and 79 are oppositely phased, thereby causing transistors $Q_9$ and $Q_{10}$ to switch alternately at a frequency determined by the RC timing circuit and the voltage on rail 63.

Resistor 71 and transistor $Q_6$ are series-connected between rails 63 and 68 and the junction between the resistor and transistor is connected to the RC timing circuit by diode 83. When transistor $Q_6$ is non-conducting, resistor 71 is connected in parallel with resistor 64 through diode 83. When resistor 71 is connected in parallel with resistor 64, the combined resistance is substantially less than the resistance of resistor 64 alone and the output frequency of driver circuit 61 is much higher than the resonant frequency of the LC circuit including inductor 98 and capacitor 99. When transistor $Q_6$ is saturated (fully conducting), diode 83 is reverse biased and the frequency of driver 61 is only slightly above the resonant frequency of the LC circuit, as determined by resistor 64 and capacitor 65 alone.

Driver 61 causes transistors $Q_9$ and $Q_{10}$ to conduct alternately under the control of inductors 78 and 79. The junction between transistors $Q_9$ and $Q_{10}$ is alternately connected to a high voltage rail, designated "+HV", and ground. The current through lamp 73 would be a series of positive pulses were it not for half bridge capacitor 76 which charges to approximately one half of the voltage of rail 81. The average DC voltage on capacitor 81 causes the current through lamp to alternate, not just pulsate. The series resonant circuit of inductor 98 and capacitor 99 causes the current through lamp 73 to be nearly sinusoidal.

The junction of transistors $Q_9$ and $Q_{10}$ is connected by line 81 through resistor 83 and capacitor 85 to ground. As transistors $Q_9$ and $Q_{10}$ alternately conduct, capacitor 85 is charged through resistor 83. Capacitor 85 and resistor 83 have a time constant of about one second. The bias network including resistors 83, 87, 89, and 91 causes the average voltage across capacitor 85 to be about twenty volts during normal operation of the ballast, even though the capacitor is charged from the high voltage rail which is at 300–400 volts.

The voltage on capacitor 85 represents a balance between the current into capacitor 85 through resistor 83 and the current out of capacitor 85 through resistors 87, 89 and 91 to ground. There is also some current to ground through the base-emitter junction of transistor $Q_6$. Transistor $Q_6$ is conductive but does not saturate and the transistor acts as a variable resistance between resistor 71 and ground.

The voltage on line 81 is proportional to the voltage from the converter, which is determined by the line voltage. If the line voltage should decrease, then the voltage on capacitor 85 decreases and less current is available at the base of transistor $Q_6$. Transistor $Q_6$ does not switch on or off but operates in a linear mode as a variable resistance. With less current available at the base of transistor $Q_6$, the collector-emitter resistance increases thereby increasing the frequency of driver 61.

Over-voltage protection is provided by transistors $Q_7$ and $Q_8$ which are a complementary pair connected in SCR configuration. The current through transistor $Q_{10}$ is sensed by resistor 93. The current is converted to a voltage and coupled by resistor 95 to the base of transistor $Q_7$, which acts as the gate or control input of the SCR. When the voltage across resistor 93 reaches a predetermined level, transistors $Q_7$ and $Q_8$ are triggered into conduction, shorting the base of transistor $Q_6$ to ground and turning off transistor $Q_6$. When transistor $Q_6$ shuts off, the frequency of driver 61 is at a maximum, as described above. When transistor $Q_6$ shuts off, the frequency of driver 61 is high and the voltage drop across resonant capacitor 99 is insufficient to sustain lamp 73, extinguishing the lamp.

Figure 3:
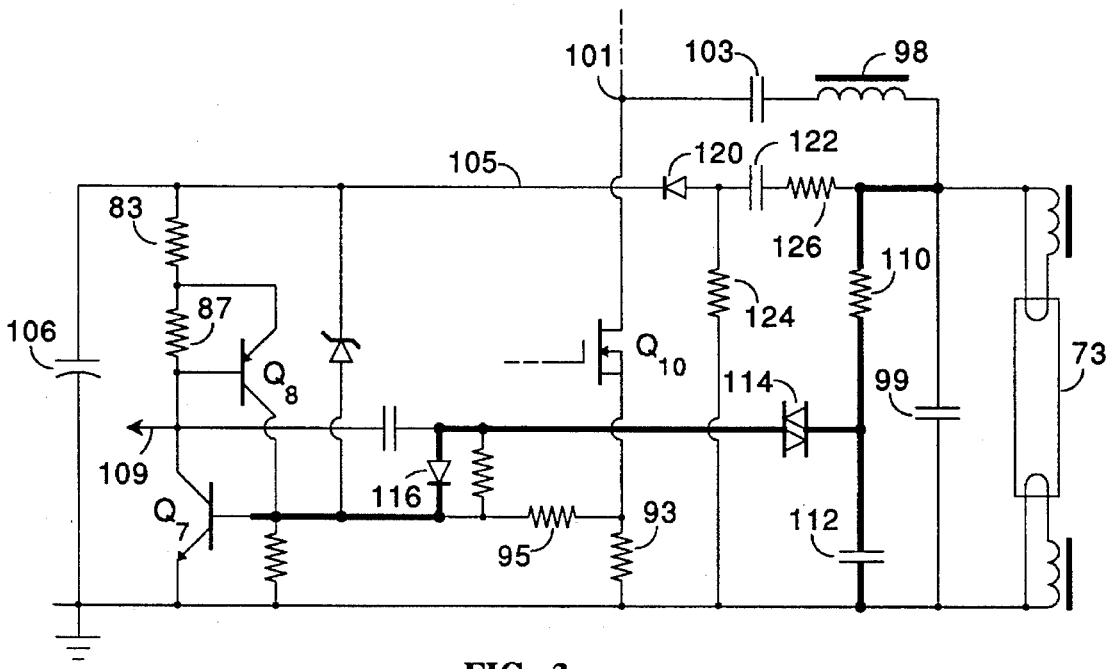
FIG. 3 is a schematic of a ballast constructed in accordance with one embodiment of the invention and operating in a first mode.

The over-voltage protection described above protects the ballast and a person coming in contact with ballast from excessive voltages. FIG. 3 illustrates one embodiment of a ballast for protecting lamps, particularly small diameter fluorescent lamps, from fault conditions which typically occur near the end of the life of the lamp.

Center point 101 is the junction between half-bridge transistors $Q_{10}$ and $Q_9$. Half bridge capacitor 103 is connected in series between center point 101 and resonant inductor 98. Line 105 is not a high voltage rail and is not connected to center point 101. Line 105 is connected to storage capacitor 106, which is charged to a low voltage for operating transistors $Q_7$ and $Q_8$. Transistors $Q_7$ and $Q_8$ are a switch means coupled to the control circuit (FIG. 2) for the inverter and provide over-voltage protection as described above in conjunction with FIG. 2. A high voltage on resistor 93 causes $Q_7$ to conduct, discharging capacitor 106 and shutting off transistor $Q_6$ (FIG. 2). Output 109 is coupled through resistor 89 to transistor $Q_6$ in FIG. 2. The lamp protection provided by the invention does not replace or impair any of the protective circuitry previously provided for protecting the ballast or a person coming in contact with the ballast.

Figure 4:
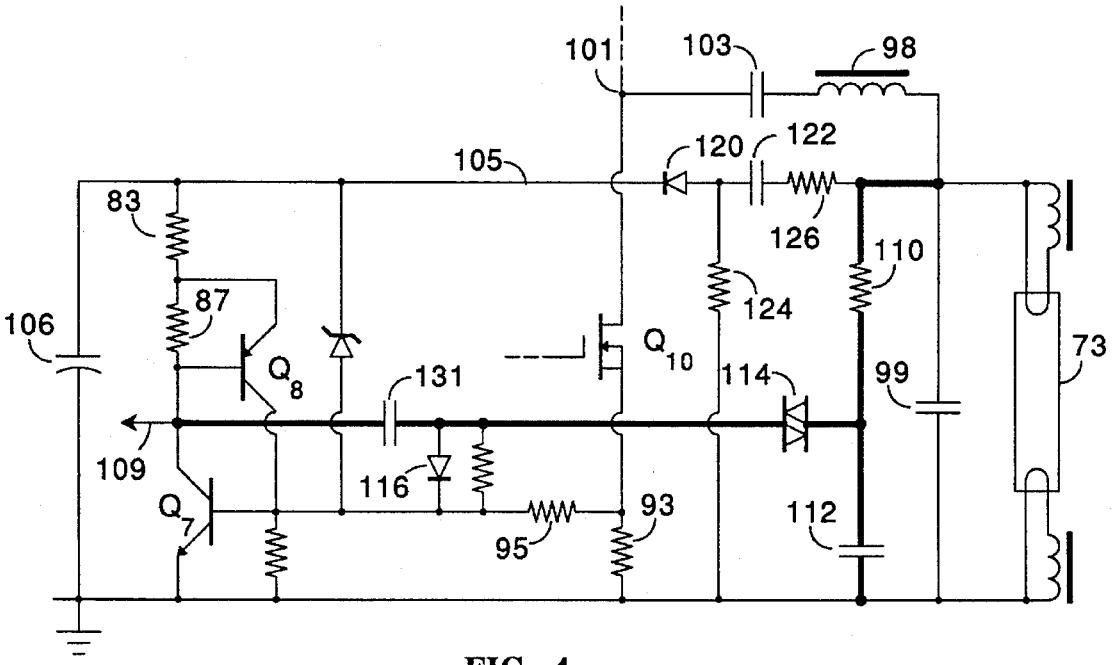
FIG. 4 illustrates the ballast of FIG. 3 operating in a second mode.
Figure 5:
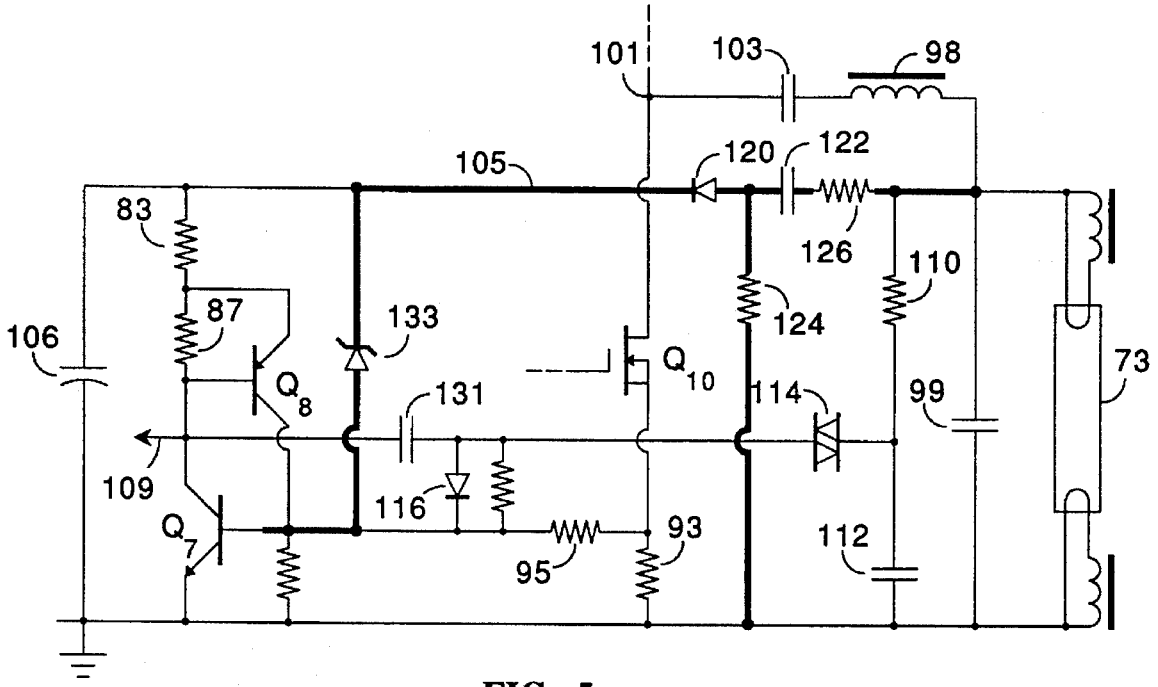
FIG. 5 illustrates the ballast of FIG. 3 operating in a third mode.

FIGS. 3–5 are identical except for thicker lines interconnecting different combinations of components. In particular, FIG. 3 illustrates a first mode of operation in which positive DC offset is detected. FIG. 4 illustrates a second mode of operation in which negative DC offset is detected. FIG. 5 illustrates a third mode of operation in which excessive AC voltage is detected.

In FIG. 3, a lamp voltage detector includes resistor 110, capacitor 112, and DIAC 114 coupled to the switch means including transistor pair $Q_7$, $Q_8$. The voltage across lamp 73 (and across resonant capacitor 99) is sampled by resistor 110 and averaged by capacitor 112. Capacitor 112 charges to a voltage equal to the net DC bias on lamp 73, if any. DIAC 114 has a breakdown voltage of 10 volts. If the voltage on capacitor 112 becomes more positive than 10 volts, DIAC 114 conducts, coupling capacitor 112 through diode 116 to the base of transistor $Q_7$. $Q_7$ turns on, discharging capacitor 106, turning off transistor $Q_6$, and reducing the voltage applied to lamp 73, as described above in conjunction with FIG. 2.

Capacitor 106 is charged by a charge pump circuit including diode 120, capacitor 122, and resistor 126. Resistor 124 limits the voltage available to the pump circuit. The values of the components in the pump circuit are chosen such that it takes approximately one second for the circuitry to pump capacitor 106 up to its normal operating voltage, assuming that a lamp is connected to the ballast and is operating normally. Transistor pair $Q_7$, $Q_8$ is disabled for about one second after it is triggered due to a fault and is disabled for about one second after power is initially applied to the ballast. Thus, the lamp protection circuitry is disabled during start up of the lamp and the protection circuitry does not interfere with start up.

FIG. 4 illustrates the operation of the lamp voltage detector when a net negative charge accumulates on capacitor 112. A net negative charge causes DIAC 114 to conduct and a negative pulse in coupled through capacitor 131 to the base of $Q_8$, which serves as a second gate or control input to the complementary pair of transistors. The negative pulse triggers the pair into conduction, discharges capacitor 106, and turns off transistor $Q_6$ (FIG. 2). The ballast will attempt to re-strike, which typically takes approximately one half second, and during which time capacitor 106 recharges. If the fault condition is not corrected, DIAC 114 is re-triggered and the ballast shuts off again.

FIG. 5 illustrates the operation of the lamp voltage detector when there is prolonged, symmetrical excess voltage applied to lamp 73. In this case, the charge pump circuitry pumps capacitor 106 to a voltage higher than the nominal 15 volts that occurs during normal operation. Zener diode 133 is coupled in parallel with capacitor 106 and has a turn-on voltage of approximately twenty volts. When the voltage on capacitor 106 reaches twenty volts, zener diode 133 conducts, turning on transistor pair $Q_7$, $Q_8$ and shutting off the ballast.

The lamp protection circuitry illustrated in FIGS. 3–5 detects a DC offset voltage of 10 volts, either positive or negative and is triggered by lamp voltages exceeding normal lamp voltages by 100 volts. The circuitry responds in much less than one second because the discharge path for capacitor 106 has a much lower impedance than the charge path, thereby preventing the filaments from heating excessively.

Figure 6:
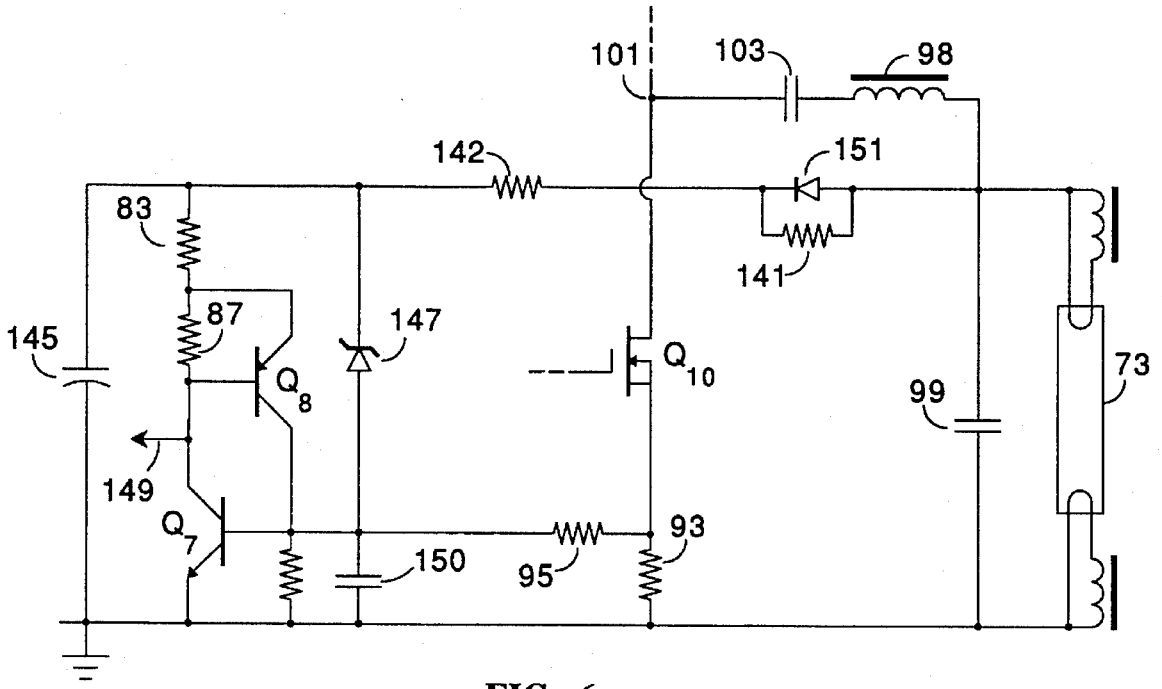
FIG. 6 illustrates lamp protection circuitry constructed in accordance with a second embodiment of the invention.

FIG. 6 illustrates a preferred embodiment of the invention which uses even fewer components than the embodiment of FIGS. 3–5. In this embodiment, the lamp voltage detector includes capacitor 145, resistor 142, diode 151, and transistor pair $Q_7$,$Q_8$. Lamp voltage is sampled by resistor 142, charging capacitor 145 to approximately 15 volts. Resistor 141 controls the AC (symmetrical voltage) sensitivity of the circuit. Decreasing the value of resistor 141 decreases the sensitivity of the circuit. Capacitor 150 aids noise suppression and could be omitted. Conversely, capacitor 150 could be added to the other embodiments of the invention.

If there is a positive DC offset on lamp 73 (lamp 73 is operating in a diode mode), then the voltage on capacitor 145 increases. Zener diode 147 has a turn-on voltage of approximately 20 volts and conducts current to the base of transistor $Q_7$, turning on transistor pair $Q_7$ and $Q_8$.

If there is a negative DC offset on lamp 73, the voltage on capacitor 145 is pulled down until there is no longer enough voltage at output 149 for transistor $Q_6$ (FIG. 2) to remain conductive and the ballast shuts off.

If there is an excessive, symmetrical voltage on lamp 73, diode 151 rectifies the voltage, converting it into a positive bias on capacitor 145 and causing Zener diode 147 to conduct. Thus, the embodiment of FIG. 6 provides protection against DC offset of either polarity on lamp 73 and protection against excessive, symmetrical AC voltages.

Figure 7:
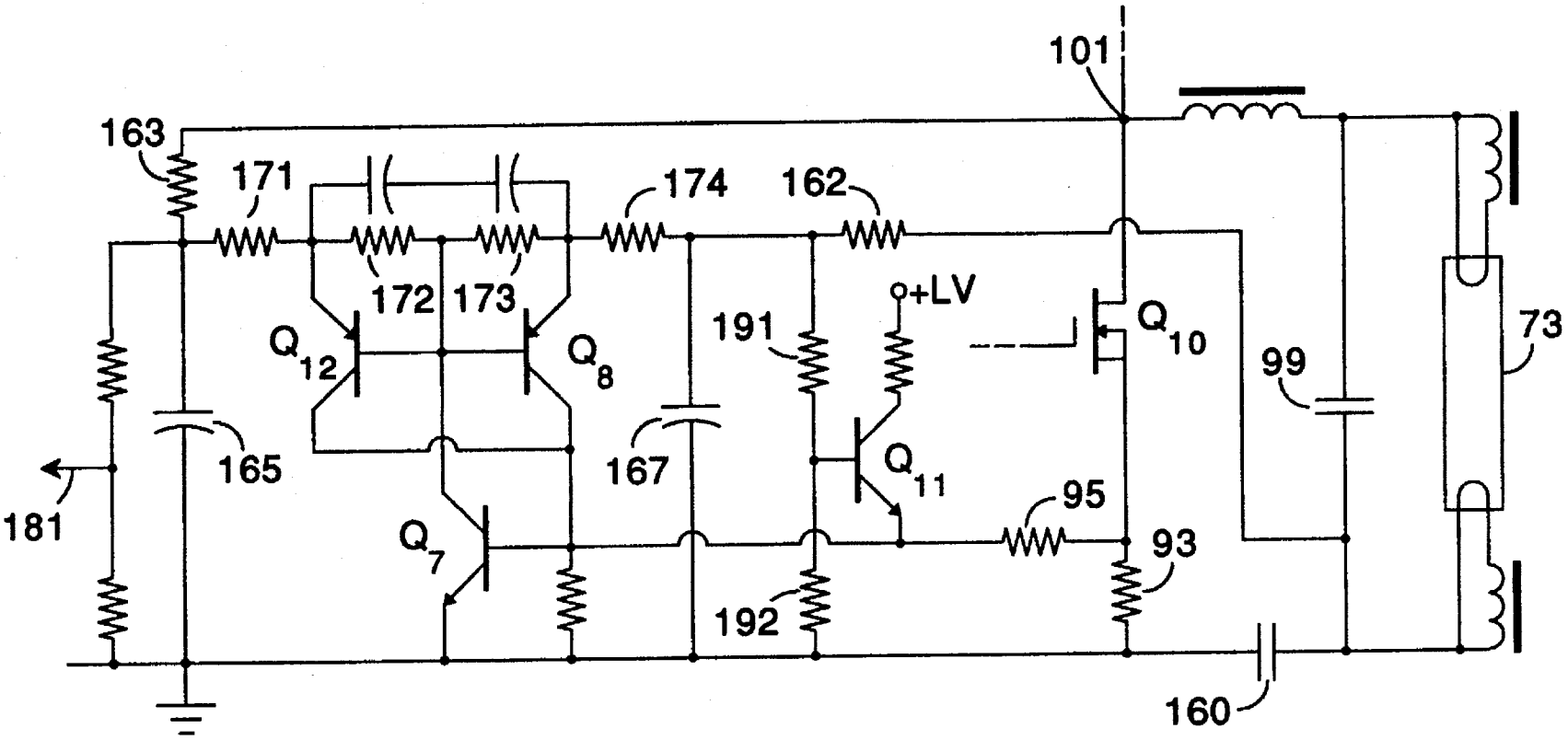
FIG. 7 illustrates lamp protection circuitry constructed in accordance with a third embodiment of the invention.

FIG. 7 illustrates another embodiment of the invention in which the lamp voltage detector includes a comparator having one input coupled to the half bridge capacitor and a second input coupled to the center point of the half bridge. In this embodiment of the invention, half bridge capacitor 160 is connected between ground and one terminal of lamp 73. The voltage across capacitor 160 is coupled by resistor 162 to one side of a comparator including transistor pair $Q_7$ and $Q_8$. Transistor $Q_{12}$ is added to the transistor pair and is coupled by resistor 163 to center point 101.

Resistors 162 and 163 have the same nominal value, approximately 330,000 ohms, and the voltages actually applied to the comparator are much lower than the voltages applied to lamp 73. Because low voltages are applied to the comparator, the voltage ratings of the components can be low, thereby enabling one to use less expensive components. Further, one can more easily detect a difference between the applied voltages since the difference is a large percentage of the applied voltages. For example, it is much easier to detect a five volt change in a fifteen volt signal than it is to detect a five volt change in a one hundred and twenty volt signal.

The signal from resistor 163 charges capacitor 165 to approximately fifteen volts during normal lamp operation. Similarly, resistor 162 charges capacitor 167 to approximately fifteen volts during normal lamp operations. Since the voltages on capacitors 165 and 167 are equal, no current flows through resistor 171–174 which are series connected between the capacitors. The junction between resistors 172 and 173 is connected to the base of transistor $Q_8$ and to the base of transistor $Q_{12}$.

If lamp 73 starts to operate in the diode mode, then the voltages on capacitors 165 and 167 will differ by a few volts. This difference in voltage causes a current to flow through resistors 171–174 and one of transistors $Q_8$ and $Q_{12}$ will be biased into conduction, depending upon the direction of current flow. If either transistor $Q_8$ or $Q_{12}$ conducts, transistor $Q_7$ conducts and capacitor 165 is discharged, thereby reducing the voltage on output 181. The reduced voltage on output 181 is insufficient to maintain transistor $Q_6$ (FIG. 2) in conduction and the ballast shuts off.

Over-voltage protection is provided by a voltage divider including resistors 191 and 192 connected in series across capacitor 167. The junction of resistor 191 and 192 is coupled to the base of transistor $Q_{11}$, which is connected between a source of low voltage, labeled "+LV", and the base of transistor $Q_7$. As the voltage on lamp 73 increases, the voltage on half bridge capacitor 160 will increase, thereby increasing the voltage on capacitor 167. As the voltage on capacitor 167 increases, transistor $Q_{11}$ is biased into conduction and passes current into the base resistor of transistor $Q_7$. The current from $Q_{11}$ biases $Q_7$ and decreases the amount of voltage from other sources required to trigger $Q_7$. If the voltage on lamp 73 continues to increase, then transistor $Q_7$ is triggered by the voltage across resistor 93, discharging capacitor 165, and shutting off the ballast. Thus, the over-voltage detector has a low sensitivity during ignition, when $Q_{11}$ is not conducting, and has a greater sensitivity after capacitor 167 charges and $Q_{11}$ is conducting.

Although illustrated as connected to capacitor 167, the over-voltage detector can be connected to either side of the comparator. The time constant of resistor 163 and capacitor 165 and the time constant of resistor 162 and capacitor 167 are such that, after discharge, it takes approximately one second for the capacitors to charge to their nominal operating voltages. Thus, the embodiment of FIG. 7 is compatible with starting voltages in excess of the voltages occurring during steady state or normal operation of lamp 73. As with the other embodiments of the invention, the charging time constant of the capacitor is much longer than the discharge time constant. For example, resistors 171 and 174 have, in one embodiment of the invention, a value of 100 ohms. Thus the discharge time constant for capacitors 165 and 167 is significantly shorter than the charging time constant. Capacitors 165 and 167, in one embodiment of the invention, have a value of 22 microfarads.

The invention thus provides a lamp protection circuit which adds relatively few components, operates at low voltages, easily detects small voltage changes relative to the nominal lamp operating voltages, and is capable of detecting DC offset and excessive AC voltage. The sensitivity of the protection circuit to DC offset is much greater than the sensitivity of the protection circuit to excessive AC voltage.

Having thus described the invention, it will be apparent to those of skill in the art that various modifications can be made within the scope of the invention. For example, transistor $Q_{11}$ can be replaced with a zener diode. Complementary transistors connected in SCR configuration are preferred for the switching means but any latching semiconductor device can be used instead. Although illustrated in several embodiments as being incorporated into the ballast illustrated in FIG. 2, the lamp protection circuitry can be used with any type of AC powered or DC powered ballast. In particular, the lamp protection circuitry can be used with self-oscillating inverters and driven inverters, half-bridge inverters and push-pull inverters. Although particularly suited to fluorescent lamps having a tube diameter of less than one inch, the invention can be used for all fluorescent lamps.

What is claimed as the invention is:

1. A lamp protective, electronic ballast for powering a gas discharge lamp, said ballast comprising:

an inverter for producing high frequency pulses and having an output for coupling the pulses to said lamp;

a control circuit coupled to said inverter and including means for shutting off said inverter;

a lamp voltage detector coupled to said lamp and to control circuit for detecting, as a first condition, when the magnitude of the DC offset across said lamp exceeds a first predetermined voltage and for detecting, as a second condition, when the magnitude of the AC voltage across said lamp exceeds a second predetermined voltage, said lamp voltage detector causing said control circuit to shut off said inverter when either condition is met.

2. The lamp protective, electronic ballast as set forth in claim 1 wherein said lamp voltage detector includes:

a first resistor and a first capacitor connected in series and having a first junction therebetween, said series connected first resistor and first capacitor being coupled in parallel with said lamp; and voltage sensitive switch means coupled between junction and said control circuit for causing said control circuit to shut off said inverter.

3. The lamp protective, electronic ballast as set forth in claim 2 wherein said voltage sensitive switch means includes a DIAC coupled to said junction for detecting DC offset in said lamp.

4. The lamp protective, electronic ballast as set forth in claim 2 wherein said lamp voltage detector further includes a second capacitor;

a charge pump circuit coupled to said second capacitor for charging said second capacitor; and wherein said voltage sensitive switch means includes a zener diode coupled to said second capacitor for detecting excessive AC voltage on said lamp.

5. The lamp protective, electronic ballast as set forth in claim 2 wherein said inverter is a half-bridge inverter including a grounded half-bridge capacitor and wherein said lamp voltage detector further includes a second resistor and a second capacitor connected in series and having a second junction therebetween, said series connected second resistor and second capacitor being coupled in parallel with said half-bridge capacitor;

and wherein said switch means includes a complementary pair of transistors, connected in SCR configuration, and a third transistor connected in parallel with one of said pair of transistors to form a comparator having a first input and a second input;

wherein said first input is coupled to said first junction and said second input is coupled to said second junction.

6. The lamp protective, electronic ballast as set forth in claim 5 and further including over-voltage detecting means coupled to either said first capacitor or said second capacitor.

7. The lamp protective, electronic ballast as set forth in claim 2 wherein said switch means includes a complementary pair of transistors, connected in SCR configuration and having a control input, said pair of transistors coupled in parallel with said first capacitor; and a zener diode coupled between said first capacitor and said control input.

8. A lamp protective, electronic ballast for powering a gas discharge lamp from an AC input voltage, said ballast comprising:

a converter for converting said AC input voltage into direct current at a high voltage;

a half-bridge inverter powered by said converter, said inverter producing high frequency pulses and having a series resonant, direct coupled output for connection to said lamp;

a control circuit coupled to said inverter for driving said inverter at a predetermined frequency, said control circuitry including means for increasing the frequency of said pulses;

a lamp voltage detector including a first capacitor, a first resistor coupled between said output and said capacitor, and a voltage sensitive switch coupled between said first capacitor and said control circuit, said voltage sensitive switch means causing said control circuit to increase the frequency of said pulses when the AC voltage across said lamp exceeds a first predetermined voltage or when the absolute value of the DC offset across said lamp exceeds a second predetermined voltage.

9. The lamp protective, electronic ballast as set forth in claim 8 wherein said first predetermined voltage is much less than said second predetermined voltage.

* * * * *